United States Patent [19]

Pratt

[11] Patent Number: 4,627,854

[45] Date of Patent: Dec. 9, 1986

[54] SELF-CONTAINED LOG FIRE STARTING KIT

[75] Inventor: Lawrence M. Pratt, Los Gatos, Calif.

[73] Assignee: Firebox Corporation, Los Gatos, Calif.

[21] Appl. No.: 794,643

[22] Filed: Nov. 4, 1985

[51] Int. Cl.[4] ..... C10L 11/00

[52] U.S. Cl. ..... 44/40; 44/38; 53/393

[58] Field of Search ..... 53/393; 44/40, 39, 38, 44/34

[56] References Cited

U.S. PATENT DOCUMENTS

| | | | |
|---|---|---|---|
| 286,103 | 10/1883 | Wood et al. | 44/40 |
| 642,266 | 1/1900 | Shelley | 44/40 |
| 3,010,809 | 11/1961 | Peck | 44/40 |
| 3,877,886 | 4/1975 | Dalzell | 44/40 |
| 4,063,904 | 12/1977 | Beeson | 44/40 |
| 4,116,645 | 9/1978 | Dalzell | 44/40 X |
| 4,460,377 | 7/1984 | Kalil | 44/40 |

*Primary Examiner*—James F. Coan

*Attorney, Agent, or Firm*—Gerald L. Moore

[57] ABSTRACT

A fire building kit comprising a carton (12) in which a spacer (30) rests on the bottom wall (14) to support paper wads (31), kindling strips (32, 35) and logs (34) all conveniently arranged to start a fire.

1 Claim, 2 Drawing Figures

SELF-CONTAINED LOG FIRE STARTING KIT

FIELD OF THE INVENTION

This invention relates to a self-contained portable carton holding combustible contents including logs for starting a log fire.

BACKGROUND OF THE INVENTION

Many times, it is convenient to transport the necessary materials for building a log fire. Such occasions involve picnics, the renting of vacation cabins and the like wherein a single fire or two is desired, but the necessary materials are not available at the site. The transport of such fire building materials is messy in that chips and bark tend to be scattered about.

It is the purpose of this invention to provide a simple and effective manner of transporting logs and fire building materials for building a log fire.

SUMMARY OF THE INVENTION

A fire building kit included in a carton made of combustible material and comprising a spacer at the bottom of the carton to allow room for insertion of paper and to provide a sufficient draft to support combustion and over which are stacked small kindling, small logs, and larger logs in that order. The carton includes a handle and is made to allow access for lighting the fire.

DESCRIPTION OF THE INVENTION

Figure 1:
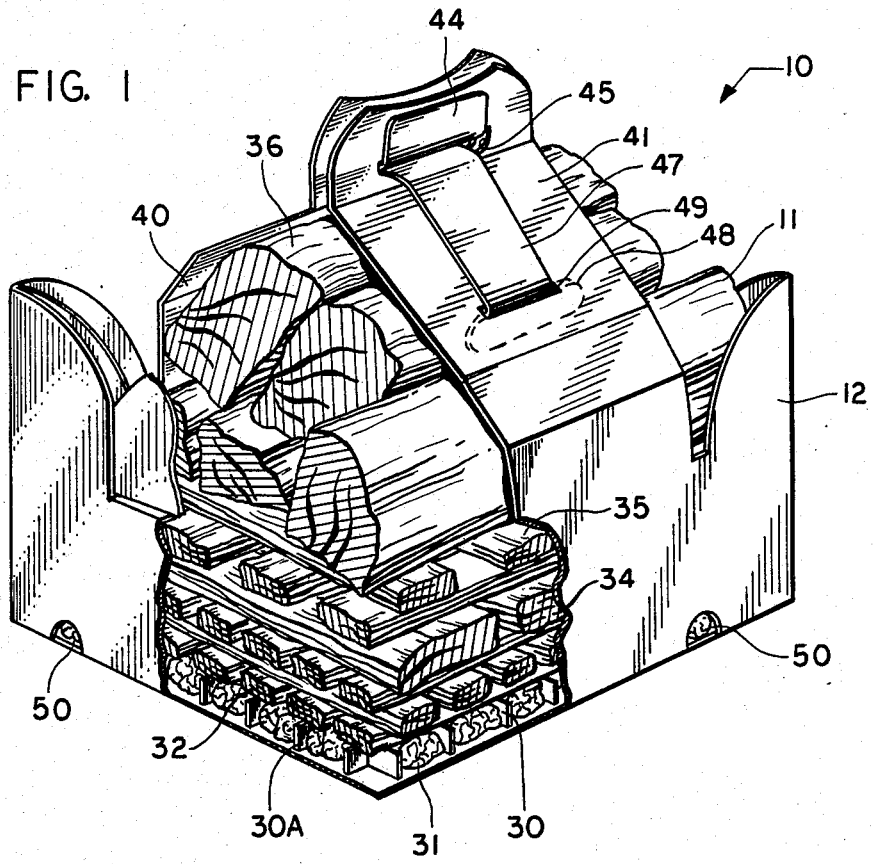
FIG. 1 is a cut-away view of the kit showing the manner in which the materials are stacked.
Figure 2:
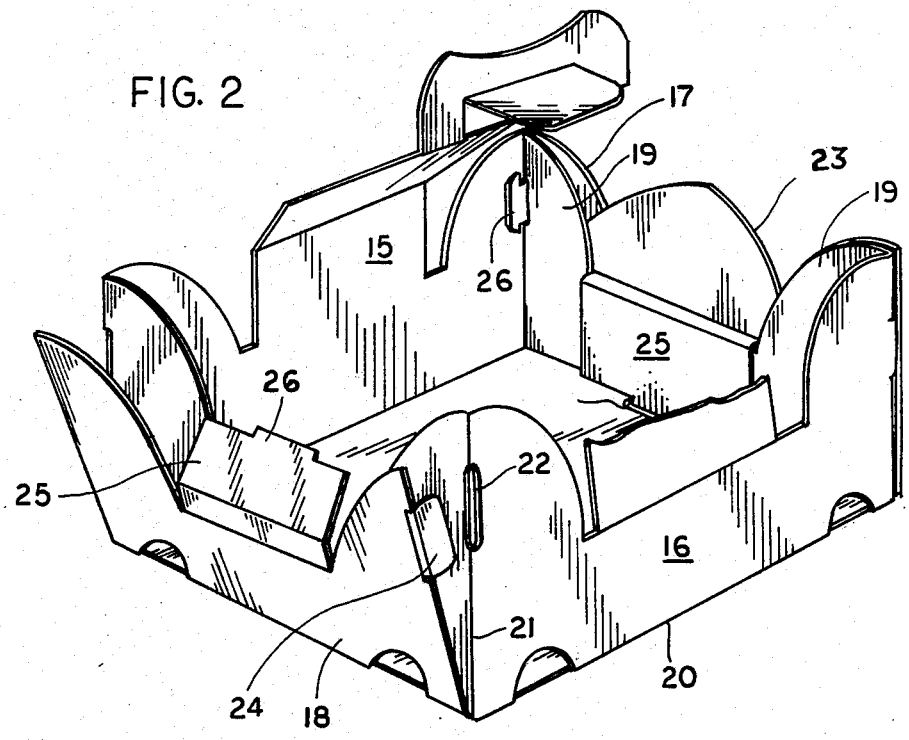
FIG. 2 is a perspective view of the carton for holding the wood.

Shown in the drawings is the kit 10 in which the fire building materials 11 are held in a carton 12. The carton is made of a combustible material such as corrugated paperboard and comprises a bottom wall 14, sidewalls 15, 16 and end walls 17 and 18. To assemble the carton, the sidewalls 15 and 16 are bent at the fold lines 20. Each side wall includes at each end a corner flap 19 each folded at the fold line 21. Each fold line 21 also includes an opening 22.

The end walls 17 and 18 are thereafter folded to a position adjacent to the corner flap with tabs 24 being inserted into the cuts 22. Thereafter, a flap 25 is folded over the center portion of the corner flaps and includes a tab 26 which is inserted into an opening 27 in the bottom wall. An end piece 23 can be inserted between the end walls 17, 18 and the flaps 25 to better hold the material in the carton.

With the carton formed in the manner just described, the combustible material can be inserted. A spacer 30 is first placed on the bottom of the carton and comprises a plurality of strips 30A standing on edge and overlapping to form a lattice, with each strip being slotted halfway through to form a junction for providing support between the strips. In this manner, the strips stand on edge and form a space between the kindling and the bottom of the carton. In the interstices between the strips is inserted the initial fire starting material in the form of paper wads 31. Thereafter, the small kindling strips 32 are laid flat on the spacer top edge forming a support for the larger logs 34. Kindling 35 is then placed cross-wise in two layers followed by the placement of the larger logs 36 on the top.

Thereafter, the handles 40 and 41, which are attached to the sidewalls 15 and 16 respectively, are folded over the logs 36 and a flap 44 fixed to one of the handles is inserted through the finger opening 45 and folded upward to form a convenient handle. A separate locking strip 47 having end tabs 48 is then inserted through the finger holes with the end tabs 48 placed through the slotted openings 49 in each handle to further hold the handles together. In this manner, the total kit can be transported merely by grasping the handle with placement of the fingers through the finger holes 45.

For lighting the fire, matches can be inserted through the openings 50 in the side and end walls or, in the alternative, the walls 17 or 18 can be folded downward to allow easier access to the combustible fire-starting materials at the bottom of the pile. The openings 50 allow air to pass into the lower area of the pile to support combustion as the fire is started.

Thus, there has been described a fire starting kit which is easily transportable and yet which includes all the necessary materials for the easy building of a log fire.

I claim:

1. A fire building kit comprising:

a carton made of combustible material and having a bottom wall, side walls and a handle extending from two side walls and over the top of said carton;

a spacer on said bottom wall;

kindling made of a combustible material resting on said spacer;

a plurality of first elongated logs of small cross section horizontally positioned on said kindling in layers with each layer being of first logs extending normal to the logs of the adjacent layer;

a plurality of second logs of greater cross section being positioned on said first logs and extending normal to said handle so as to be held tightly when the carton is lifted by said handle; and a highly combustible fire starter such as paper inside said spacer whereby when said kindling is ignited, the first logs will burn evenly and provide a level platform during the ignition and burning of said second logs.

* * * * *